US007198050B2

(12) United States Patent
Gopou et al.

(10) Patent No.: US 7,198,050 B2
(45) Date of Patent: Apr. 3, 2007

(54) HAIR SCULPTING DEVICE AND METHODS

(76) Inventors: Brigitte Gopou, 8522 Park La. #2, Dallas, TX (US) 75231; Bruce Boyd, 2700 Swiss Ave. #5, Dallas, TX (US) 75205

( * ) Notice: Subject to any disclaimer, the term of this patent is extended or adjusted under 35 U.S.C. 154(b) by 96 days.

(21) Appl. No.: 10/925,126

(22) Filed: Aug. 24, 2004

(65) Prior Publication Data

US 2006/0042646 A1 Mar. 2, 2006

(51) Int. Cl.
*A45D 7/00* (2006.01)
*A47K 7/02* (2006.01)

(52) U.S. Cl. ..... 132/210; 15/244.1

(58) Field of Classification Search ..... 132/207, 132/210, 212, 333; 15/244.1, 244.4; 206/581, 206/823

See application file for complete search history.

(56) References Cited

U.S. PATENT DOCUMENTS 792,278 A * 6/1905 McCarthy ..... 401/205
1,378,931 A * 5/1921 Adler ..... 510/180
1,575,939 A * 3/1926 Satterwhite et al. ..... 15/396
1,943,365 A * 1/1934 Borden ..... 15/244.4
2,030,911 A * 2/1936 Borden ..... 402/266
2,122,090 A * 6/1938 Creighton ..... 15/244.1
2,588,773 A * 3/1952 Smith ..... 401/201
3,262,459 A * 7/1966 Sheehan ..... 132/212
3,955,233 A * 5/1976 Nakamura ..... 15/209.1
5,003,659 A * 4/1991 Paepke ..... 15/229.13
D332,841 S * 1/1993 Levison ..... D28/63
6,325,565 B1 * 12/2001 Girardot et al. ..... 401/266

* cited by examiner

*Primary Examiner*—Cris Rodriguez
*Assistant Examiner*—Rachel A. Running
(74) *Attorney, Agent, or Firm*—Roger S. Burleigh

(57) ABSTRACT

A handheld device for sculpting hair includes a pliable member having a substantially smooth bottom surface. A plurality of spaced-apart bores are disposed in the bottom surface. When the handheld device is placed against a person's head, the pliable member at least partially deforms to conform to the shape of the person's head. By repeatedly pulling the bottom surface of the pliable member across the hair tangentially to the surface of the person's scalp, the plurality of spaced-apart bores disposed in the bottom surface cause clumps of hair to be formed at substantially regular intervals that are a function of the distance between ones of the spaced-apart bores.

15 Claims, 1 Drawing Sheet

HAIR SCULPTING DEVICE AND METHODS

TECHNICAL FIELD OF THE INVENTION

The present invention is directed, in general, to hair care accessories and, more specifically, to devices and methods for sculpting hair.

BACKGROUND

Various devices, such as combs, barrettes, clips, bows, and the like to shape, or "sculpt," hair have been known for thousand of years. Such devices are commonly available in a plethora of colors and designs, and are used for functional as well as aesthetic reasons. Although prior art hair devices are useful, such devices are generally designed to address only one or a few contemplated hair styles.

In recent years, a hair style that has become popular, particularly among person's of African descent, features clumps of twisted hair distributed relatively uniformly over the person's scalp. Because of the typically coarse nature of the hair of persons of African descent, the clumps of hair remain twisted together without the general need for any mechanical devices or styling products, such as conventional hair gel or spray. Whereas the hairstyle typically requires 50 or more individual clumps of twisted hair to be individually and manually formed, it can take a considerable amount of time to produce the desired result. Furthermore, it is very awkward for an individual to style their own hair, particularly on the back portion of the scalp where it is difficult to simultaneous view and manipulate the hair. This creates the need to use a hair stylist every time it is necessary to reform the individual twisted clumps of hair.

Accordingly, there is a need in the art for a hair sculpting device, and methods of use thereof, for forming clumps of twisted hair distributed relatively uniformly over a person's scalp.

BRIEF SUMMARY OF THE INVENTION

To address the above-described deficiencies of the prior art, novel hair sculpting devices, and methods of use thereof, are disclosed herein. According to the principles of the invention, a handheld device for sculpting hair includes a pliable member having a top surface and a bottom surface. A plurality of spaced-apart bores are disposed in the bottom surface. When the handheld device is placed against a person's head, the pliable member at least partially deforms to conform to the shape of the person's head. By repeatedly pulling the bottom surface of the pliable member across the hair tangentially to the surface of the person's scalp, the plurality of spaced-apart bores disposed in the bottom surface cause clumps of hair to be formed at substantially regular intervals that are a function of the distance between ones of the spaced-apart bores.

In an exemplary embodiment, the pliable member is compressible. A suitable compressible material is open cell foam, commonly manufactured from polyurethane.

In a particular embodiment, the spaced-apart bores have a diameter of substantially 0.25 inches, a depth of substantially 1.75 inch, and the distance between the centers of adjacent ones of the spaced-apart bores is substantially 0.5 inch. In an alternate embodiment, the spaced-apart bores extend from the bottom surface through the top surface of the pliable member.

In an exemplary embodiment, the top surface and the bottom surface of the pliable member are substantially parallel, and the dimension between the top surface and the bottom surface is substantially two inches.

In an exemplary embodiment, the device further includes a handle member coupled to the pliable member. In one embodiment, the handle member is coupled to the top surface of the pliable member. Suitable materials for the handle member include plastic which, in an exemplary embodiment, is semi-rigid.

The foregoing has outlined, rather broadly, the principles of the present invention so that those skilled in the art may better understand the detailed description that follows. Those skilled in the art should appreciate that they can readily use the disclosed conception and exemplary embodiments as a basis for designing or modifying other structures and methods for carrying out the same purposes of the present invention, and that such equivalent constructions do not depart from the spirit and scope of the invention in its broadest form, except as specifically limited by the claims recited hereinafter.

BRIEF DESCRIPTION OF THE DRAWINGS

For a more complete understanding of the present invention, reference is now made to the following detailed description taken in conjunction with the accompanying drawings, in which.

DETAILED DESCRIPTION OF THE INVENTION

The inventor has discovered, by unexpected result, a hair sculpting device, and methods of use thereof, for forming clumps of twisted hair distributed relatively uniformly over a person's scalp. Exemplary devices, and use thereof, are illustrated in FIGS. 1–7.

Figure 1:
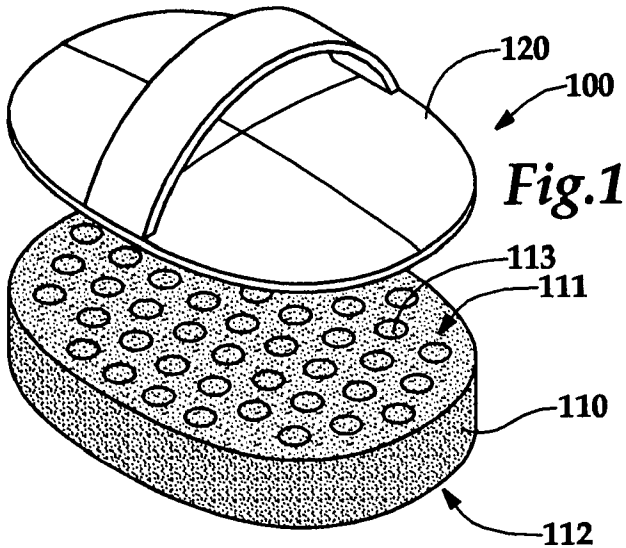
FIG. 1 illustrates an exemplary hair sculpting device in accordance with the principles of the present invention.
Figure 2:
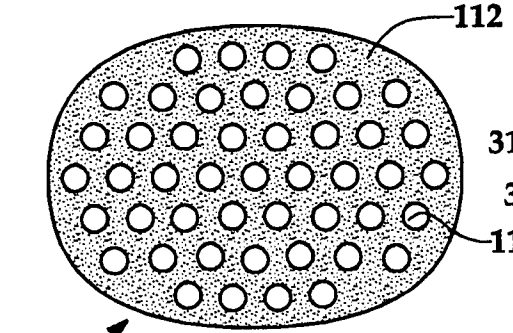
FIG. 2 illustrates a bottom view of an exemplary hair sculpting device in accordance with the principles of the present invention.

Referring initially to FIGS. 1 and 2, illustrated is an exemplary hair sculpting device 100. Hair sculpting device 100 includes a pliable member 110 having a top surface 111 and a substantially smooth bottom surface 112. Although the bottom surface 112 is illustrated in the figures as having a substantially flat profile, the bottom surface can have a moderately-curved, or concave, shape suitable to more precisely match the average curvature of a person's scalp.

In an exemplary embodiment, the pliable member 110 is compressible. A suitable compressible material for pliable member 110 is open cell foam, commonly manufactured from polyurethane. In an exemplary embodiment, the pliable member 110 is formed from open cell polyurethane foam, Product Number 90180GY20, as supplied by Future Foam, Inc. (1610 Avenue N; Council Bluffs, Iowa 51501). As based on ASTM test methods, the exemplary open cell foam has the following specifications: density of 1.80±0.1 lbs./cu. ft.; tensile strength of 15 p.s.i. (minimum); elongation of 125%

(minimum); tear resistance of 1.50 lbs./lin. inch (minimum); compression set @50% comp. of 10% (maximum); and indent force deflection @25% of 90±9 lbs./50 sq. in.

A plurality of spaced-apart bores, generally designated 113, are disposed in the pliable member 110. As illustrated more particularly with respect to FIGS. 3 and 4, the bores 113/313/413 extend through the pliable member 110/310/410 from the bottom surface 112/312/412, but not necessarily through the top surface 111/311/411. In a particular embodiment, the spaced-apart bores 113 have a diameter of substantially 0.25 inches, a depth of substantially 1.75 inch, and the distance between the centers of adjacent ones of the spaced-apart bores 113 is substantially 0.5 inch. The hair sculpting device 100 can be formed in any desired shape, such as round, square, rectangular or elliptical, provided that it has a substantially smooth bottom surface 112 through which the spaced-apart bores 113 are disposed.

Figure 3:
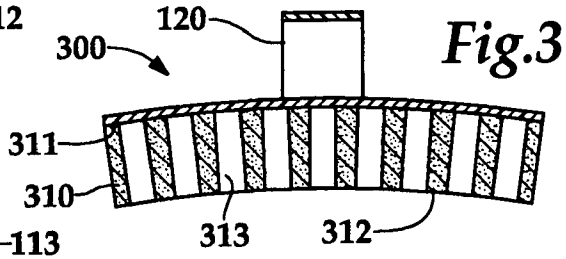
FIGS. 3 and 4 illustrate cross-sectional views of two exemplary hair sculpting devices in accordance with the principles of the present invention.
Figure 4:
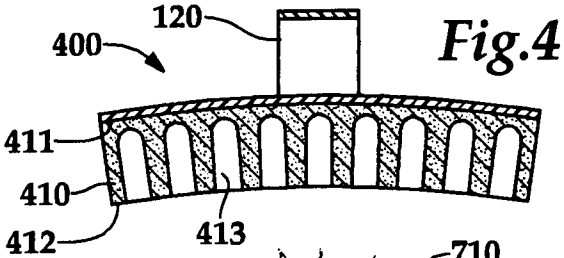

In a particular embodiment, the top surface 111 and the bottom surface 112 of the pliable member 110 are substantially parallel, and the dimension between the top surface and the bottom surface is substantially two inches. In alternate embodiments, the top surface 111 can be shaped in other desirable forms, such as to conform to a user's hand. In the exemplary embodiment, the hair sculpting device 100 includes a handle member 120 that is coupled to the pliable member 110 as more fully illustrated in FIGS. 3 and 4. Although the handle member 120 is illustrated as being coupled to the top surface 111 of the pliable member 110, those skilled in the art will recognize that other configurations are suitable for the purposes of the invention. Suitable materials for the handle member include plastic which, in an exemplary embodiment, is semi-rigid. As illustrated in FIGS. 3 and 4, in which the handle member 120 is semi-rigid, it can be seen that its shape deforms in relation to the deformation of the pliable member 310/410. Those skilled in the art will appreciate that, in general, the need for the handle member 110 to deform is inversely-related to the thickness of pliable member 310/410.

Referring now to FIGS. 3 and 4, illustrated are cross-sectional views of different exemplary hair sculpting devices 300 and 400, respectively. In FIG. 3, it can be seen that the plurality of spaced-apart bores, generally designated 313, are disposed in and extend through the pliable member 310 from the bottom surface 312 through the top surface 311. In an alternate embodiment, illustrated in FIG. 4, it can be seen that the plurality of spaced-apart bores, generally designated 413, are disposed in the pliable member 410 through the bottom surface 412, but do not extend through the top surface 411.

Figure 5:
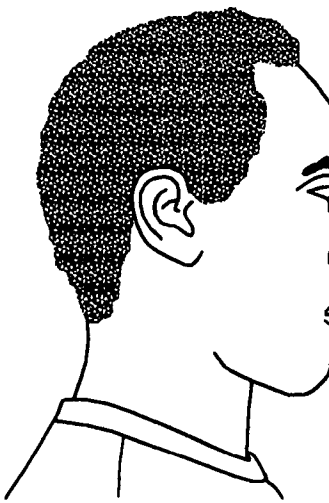
FIG. 5 illustrates a person's hair prior to styling.
Figure 6:
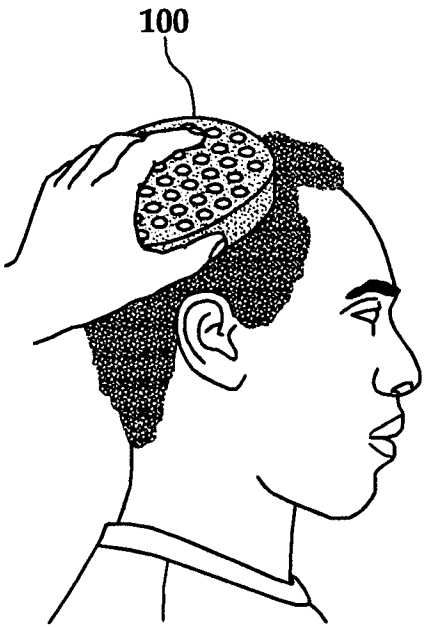
FIG. 6 illustrates use of a hair sculpting device in accordance with the principles of the present invention.
Figure 7:
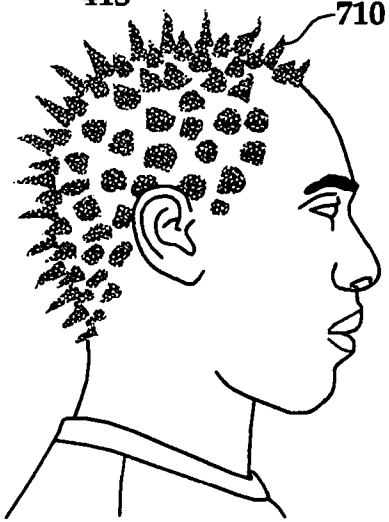
FIG. 7 illustrates a person's hair after styling using a hair sculpting device in accordance with the principles of the present invention.

Finally, reference is made to FIGS. 5, 6 and 7, by which use of a hair sculpting device in accordance with the principles of the present invention is illustrated. FIG. 5 illustrates a person's hair prior to styling, which is preferably prepared as a relatively uniform "afro." FIG. 6 illustrates use of the hair sculpting device 100. When the hair sculpting device 100 is placed against a person's head, the pliable member 110 at least partially deforms to conform to the shape of the person's head. The bottom surface 112 of the pliable member 110 of the hair sculpting device 100 is repeatedly pulled across the hair tangentially to the surface of the person's scalp; preferably, the hair sculpting device 100 is moved across the hair in a circular rubbing motion. As the hair sculpting device 100 is pulled over the hair, the plurality of spaced-apart bores 113 disposed in the bottom surface 112 cause clumps of hair to be formed at substantially regular intervals that are a function of the distance between ones of the spaced-apart bores 113. Such clumps of hair, generally designated 710, are illustrated in FIG. 7. Once a general pattern of clumps 710 are formed across the scalp, the user, or stylist, can manually shape the clumps using their fingers and, if desired, a styling cream. In addition, cream can be applied to the hair prior to styling in order to smooth the movement of the sculpting device 100 over the hair.

Although the present invention has been described in detail, those skilled in the art will conceive of various changes, substitutions and alterations to the exemplary embodiments described herein without departing from the spirit and scope of the invention in its broadest form. The exemplary embodiments presented herein illustrate the principles of the invention and are not intended to be exhaustive or to limit the invention to the specific form disclosed; it is intended that the scope of the invention only be limited to the scope of the claims appended hereto.

What is claimed is:

1. A method of sculpting hair, said method comprising the steps of:

grasping a reusable handheld device comprising:

a pliable member having a substantially smooth bottom surface;

and a plurality of spaced-apart bores disposed in said bottom surface; applying a styling liquid to said pliable member or said hair, said pliable member being free of said styling liquid Drior to first use;

placing said device against a person's head, said pliable member at least partially deforming to conform to the shape of said person's head; and, repeatedly pulling said bottom surface of said pliable member across said hair tangentially to the surface of said person's scalp, said plurality of spaced-apart bores disposed in said bottom surface causing clumps of said hair to be formed at substantially regular intervals that are a function of the distance between ones of said spaced-apart bores, said styling liquid operative to smooth the movement of the device over the hair and aid in the formation of said clumps.

2. The method recited in claim 1, wherein said pliable member is compressible.

3. The method recited in claim 2, wherein said pliable member comprises open cell foam.

4. The method recited in claim 3, wherein said open cell foam comprises polyurethane.

5. The method recited in claim 1, wherein each of said plurality of spaced-apart bores has a diameter of substantially 0.5 inches.

6. The method recited in claim 1, wherein each of said plurality of spaced-apart bores has a depth of substantially 1 inch.

7. The method recited in claim 1, wherein the distance between the centers of adjacent ones of said plurality of spaced-apart bores is substantially 1 inch.

8. The method recited in claim 1, wherein said plurality of spaced-apart bores disposed in said bottom surface extend through a top surface of said pliable member.

9. The method recited in claim 1, wherein a top surface and said bottom surface of said pliable member are substantially parallel.

10. The method recited in claim 9, wherein said pliable member has a dimension between said top surface and said bottom surface of substantially two inches.

11. The method recited in claim 1, further comprising a handle member coupled to said pliable member.

12. The method recited in claim 11, wherein said handle member is coupled to a top surface of said pliable member.

13. The method recited in claim 11, wherein said handle member comprises plastic.

14. The method recited in claim 13, wherein said plastic is semi-rigid.

15. The method recited in claim 1, wherein said liquid is a cream.

* * * * *